US005526946A

United States Patent [19]

Overton

[11] Patent Number: 5,526,946

[45] Date of Patent: Jun. 18, 1996

[54] ANTI-SWAY CONTROL SYSTEM FOR CANTILEVER CRANES

[75] Inventor: Robert H. Overton, Virginia Beach, Va.

[73] Assignee: Daniel H. Wagner Associates, Inc., Hampton, Va.

[21] Appl. No.: 349,531

[22] Filed: Dec. 5, 1994

Related U.S. Application Data

[63] Continuation-in-part of Ser. No. 82,754, Jun. 25, 1993, abandoned.

[51] Int. Cl.[6] ..... B66C 13/06

[52] U.S. Cl. ..... 212/275

[58] Field of Search ..... 212/275

[56] References Cited

U.S. PATENT DOCUMENTS

| | | | |
|---|---|---|---|
| 3,351,213 | 11/1967 | Newman et al. | 212/275 |
| 4,756,432 | 7/1988 | Kawashima et al. | 212/275 |
| 4,997,095 | 3/1991 | Jones et al. | 212/275 |
| 5,127,533 | 7/1992 | Virkkunen | 212/275 |
| 5,219,420 | 6/1993 | Kiiski et al. | 212/275 |

*Primary Examiner*—Karen B. Merritt
*Assistant Examiner*—Thomas J. Brahan
*Attorney, Agent, or Firm*—Wallace J. Nelson

[57] ABSTRACT

A process employing a computer controlled crane system for controlling the motion of a movable trolley from which a load is suspended at a variable hoist length therefrom to meet a selected arbitrary horizontal velocity reference while preventing sway of the load involves the steps of first, determining a lateral acceleration to reduce by a factor of one-half the sway energy contributed by (1) hoisting a load while the load is swaying; (2) non-linearities in the pendulum motion; (3) external forces such as wind, crane motion; and (4) non-vertical lifting of the load. Second, an additional acceleration of the same magnitude, but of opposite sign, is applied one-half a pendulum period latter to correct the remaining of the excess sway energy. Next, a lateral acceleration is applied to the load to respond to velocity demand as determined by the current trolley velocity and the predicted velocity change resulting from future sway-damping acceleration, and a lateral acceleration is applied to dampen the sway induced by the trolley employing a time-delay transfer law. All of these steps are applied additively to accelerate the trolley and all steps repeated at a sampling rate proportional to the sway period of the attached load.

5 Claims, 1 Drawing Sheet

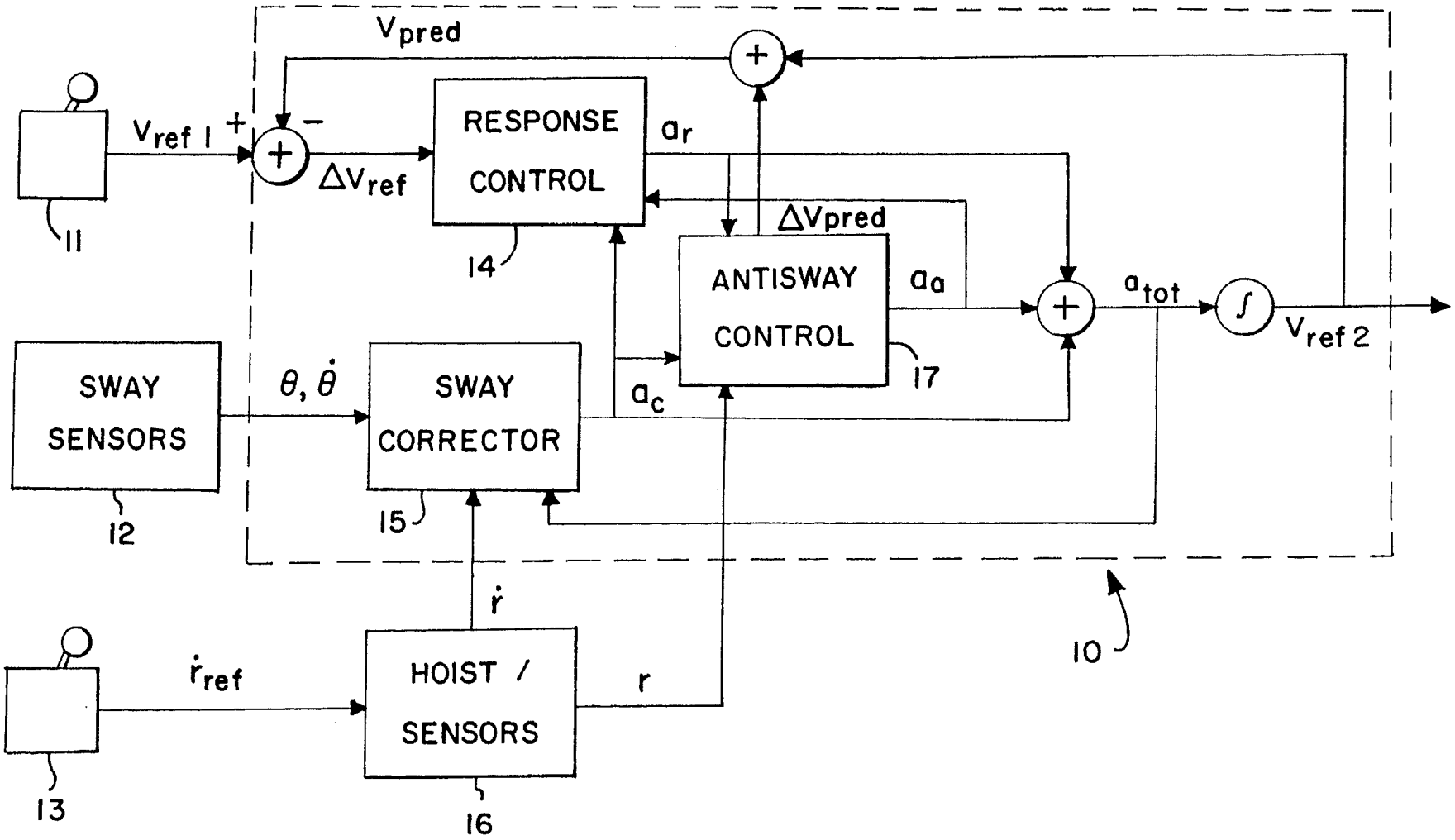
$V_{ref\,2}$
$a_{tot}$
10
$a_a$
17
$\Delta V_{pred}$
ANTISWAY CONTROL
$a_r$
$a_c$
RESPONSE CONTROL
14
SWAY CORRECTOR
15
$\dot{r}$
r
HOIST / SENSORS
16
$V_{pred}$
$\Delta V_{ref}$
$\theta, \dot{\theta}$
$V_{ref\,1}$
SWAY SENSORS
12
$\dot{r}_{ref}$
11
13

ANTI-SWAY CONTROL SYSTEM FOR CANTILEVER CRANES

CROSS-REFERENCE

This application is a continuation-in-part application of commonly owned, patent application Ser. No. 08/082,754, filed Jun. 25, 1993, now abandoned.

FIELD OF THE INVENTION

This invention relates to crane control systems in general, and relates specifically to anti-sway systems for level-beam; cantilever cranes wherein the load is hoisted by a cable suspended from a trolley, and is transported horizontally by moving the trolley along the beam.

BACKGROUND OF THE INVENTION

The system of the present invention is applicable to any crane of level-beam design, wherein the load is transported horizontally by moving a trolley out along a beam. Crane systems of this type include gantry cranes and overhead-transport devices; and the present invention is particularly adapted for, and is further described herein for, loading cranes used for loading container cargo onto ships at pier-side. Exemplary systems suitable for practice of the present invention are shown in U.S. Pat. Nos. 5,089,972 and 5,142,658.

Despite efforts to improve and automate the process of loading containers onto ships at pierside, the mode of operation continues to be manually intensive and time consuming. The principal factor in the inefficiency of the operation is at the end of each loading operation ("move") when the operator attempts to pick up or place the load. Sway induced while the load (or empty spreader) was transported between pier and ship must be killed by the operator during the move itself or at the end. Only the most experienced operators can simultaneously kill sway and bring the load or spreader to a specified target location; the rest must accomplish these goals in two separate operations. As a result, the time spent waiting for the container to stop swinging and fine-positioning it at the end of the loading operation occupies, on average, more than one third of the entire move.

One way to reduce this waiting time is to employ an anti-sway trolley motion control law, that meets the operator's velocity or position demand, and yet produces zero net sway at the end of the move. To be successful, such a control law must be safe, and must be amenable to manual operation, wherein trolley velocity reference signals are generated by an operator's control stick and the control law is designed to meet this reference value with no residual sway. There is also a smoothness constraint, imposed by the fact that the operator co-controls the process, and may be physically located in a cab attached to the trolley. Finally, there are external causes of sway, such as wind, crane motion, and non-vertical lifting of the load, so an effective system should be able to remove sway induced by such external factors.

The primary sources of sway are the initial acceleration of the trolley in the direction of its destination, and the final deceleration to stop the trolley at the end of the move. The sway caused by initial acceleration is unavoidable if the load is to be moved at all. However, this sway can be efficiently and smoothly removed before the trolley reaches its reference velocity, by a previously known "double pulse" anti-sway control law whereby the sway induced by an initial acceleration is removed by a second acceleration of the same sign, magnitude, and duration, timed to commence one-half a sway period after the commencement of the first pulse. To meet a given velocity reference, the first acceleration pulse is of sufficient length to accelerate to one-half the reference velocity; the second acceleration pulse then accelerates the trolley to the full reference velocity. To stop the load, the reference velocity is simply set to zero, and the same double-pulse method is applied to decelerate to this new reference without residual sway. The basic double-pulse approach is taught by U.S. Pat. No. 4,756,432.

This process can be extended naturally in two previously-known ways. First, if the load suspension system is linear, the double pulse strategy can be used to meet arbitrary varying trolley velocity demands by superposing the response to each new velocity demand on the responses to the previous ones Second, if the hoist length changes, the change in pendulum period can be accommodated by normalizing the measurement of time in dividing by the sway period. If, for example, the first acceleration pulse is executed and then the load is raised, shortening the hoist length and hence the sway period, then the second, anti-sway acceleration pulse will occur earlier than for the longer hoist length, and will be of shorter duration. These extensions are taught by U.S. Pat. No. 3,517,830 and particularly by Virkkunen, U.S. Pat. No. 5,127,533.

In Virkkunen's system, variable control intervals are employed to handle the change in pendulum period when the load is hoisted or lowered. However, Virkkunen's system has the drawback, that when the hoist length is changed, the anti-sway acceleration pulses will no longer be of the same duration as the accelerations with which they are paired. Thus, if the hoist length is changed, the original acceleration meets half the trolley velocity reference, but the antisway accelerations will no longer integrate to the other half of the reference velocity because the antisway pulses are now of longer or shorter duration than the original pulses. Consequently, the system will exceed or fall short of the target velocity.

Further, in the prior art no account is made for the energy added to, or subtracted from, the pendulum as a result of hoisting while the load is swinging; and existing double-pulse controls do not account for externally-induced sway from wind, from initial sway, and the like.

Accordingly, while the Virkkunen law has been applied successfully to shop cranes with long hang lengths and low hoist rates, it is not adequate for container cranes, which have relatively short hang lengths and high hoist rates; which operate outdoors; and where speed demands (especially for zero speed) must be met precisely.

It is an object of the present invention to provide an alternative to the basic double pulse law that eliminates the drawbacks of existing systems referred to above; that is, to control the trolley accelerations in such a way that the reference velocity is met exactly, that hoist-induced sway is fully corrected, and that externally-induced sway can be removed.

Another object of the present invention is to provide a safe control system for minimizing sway in movement of containerized cargo by an overhead crane assembly.

An additional object of the present invention is an automated, anti-sway, system for cranes that can be co-controlled by the crane operator, can be overridden by the crane operator, and is also capable of being operated in the manual mode by the crane operator.

Another object of the present invention is an anti-sway system for crane operations that eliminates sway caused by external wind and ship motion in loading of containerized cargo onto ships.

SUMMARY OF THE INVENTION

According to the present invention, the foregoing and additional objects are attained by providing a process employing a computer controlled crane system for controlling the motion of a movable trolley from which a load is suspended at a variable hoist length therefrom to meet a selected arbitrary horizontal velocity reference while preventing sway of the load. This anti-sway process of the present invention involves the steps of first, determining a lateral acceleration to reduce by a factor of one-half the sway energy contributed by (1) hoisting a load while the load is swaying; (2) non-linearities in the pendulum motion; (3) external forces such as wind, crane motion; and (4) non-vertical lifting of the load. Second, an additional acceleration of the same magnitude but of opposite sign is scheduled to be applied one-half a pendulum period latter to correct the remaining of the excess sway energy. Next, a lateral acceleration is applied to the load to respond to velocity demand as determined by the current load attachment point velocity and the predicted velocity change resulting from future sway-damping acceleration; and a lateral acceleration is applied to dampen the sway induced by the load attachment point employing a time-delay transfer law. All of these steps are applied additively to accelerate the attachment point and all steps repeated at a sampling rate proportional to the sway period of the attached load.

BRIEF DESCRIPTION OF THE DRAWING

A more complete appreciation of the invention and many of the attendance advantages thereof will be better understood when considered in connection with the accompanying drawing, wherein:

The single Figure is a schematic representation of a control system utilized to implement the invention on an example crane.

DETAILED DESCRIPTION

The present invention is a control law to govern the lateral motion of a suspension point from which a load is suspended, by cables or other means, at a variable height. Throughout this description, the attachment point is referred to as the "trolley", and varying the suspension height of the load is referred to as "hoisting."

Referring now to the drawing, the process of the present invention is shown inside the boundary of dashed rectangle 10. At any instant, a trolley reference velocity, labeled $V_{ref1}$, is obtained from an outside authority, denoted by reference numeral 11 in the drawing. This reference may be generated by an operator's stick, as illustrated, generated by a computer, or may be obtained from another unspecified outside source. The trolley propulsion system is constrained by a maximum speed (8.33 ft/sec for the same family of cranes) and a maximum trolley acceleration (3.18 ft/sec$^2$ for the same family of cranes). This fixed maximum trolley acceleration to be used to move the load is referred to herein as $a_{max}$.

Sway may be induced by outside agents such as wind and non-vertical lifting of the load. Optionally, the total sway $\theta$, $\theta$ is read by sway sensors, denoted by reference numeral 12, and the externally-induced sway is removed by the present invention.

The load is hoisted or lowered in response to a reference signal ($\dot{r}_{ref}$) from the same or other independent authority as that for trolley velocity, as indicated by reference number 13, and the hoist length, r, and hoist rate $\dot{F}$, are obtained from sensors associated with the hoisting system, collectively denoted by reference number 16. All of this hoisting and sensing process is not included in dashed rectangle 10 and is external to the present invention.

It is assumed that the trolley reference velocity $V_{ref1}$ is desired to be met, and the control objective of the present invention is to accelerate the trolley and load to the reference velocity in an acceptable time, with no residual sway. The control must respond efficiently to changes in operator demands, and must accommodate arbitrary hoisting, up to some fixed maximum hoist rate determined by the physical limitations of the crane (3.1 ft/sec is specified for one family of cranes). The preferred implementation, as shown, generates a total acceleration $a_{tot}$, integrates $a_{tot}$ to a new reference velocity, $V_{ref2}$, and sends this new reference velocity to the crane drives in place of $V_{ref1}$. Alternative implementations send the desired accelerations, indicated as $a_{tot}$, or other equivalent indicators of the desired trolley motor actions, instead of $V_{ref2}$, to the drive motor controls.

The present invention meets the reference velocity (i.e., $V_{ref2}$ becomes $V_{ref1}$) by means of three interrelated controls, each of which produces a component of the trolley acceleration to be carried out by the drive motors. These control mechanisms are referred to herein as the Response Control, the Sway Corrector, and the Antisway Control, as so labeled and denoted by the respective reference numbers, 14, 15, and 17, and the acceleration components they produce are referred to herein as the Response Acceleration ($a_r$), the Correction Acceleration ($a_c$), and the Antisway Acceleration ($a_a$), respectively. The overall function of each component is as follows.

The function of Response Control 14 is to make the difference between the reference velocity input $V_{ref1}$ and the predicted velocity, labeled $V_{pred}$, equal zero. The predicted velocity is the sum of the current reference velocity output $V_{ref2}$ and the predicted change in velocity that will occur as a result of later antisway accelerations. This predicted change is labeled $\Delta V_{pred}$. The output of Response Control 14 is a response acceleration, $a_r$. The internal processing of Response Control 14 is described in further detail hereinbelow.

The function of Sway Corrector 15 is to remove one-half of the sway induced by hoisting and by external factors. Sway Corrector 15 is governed by the sway $\theta$, the sway rate $\dot{\theta}$, and the hoist rate $\dot{r}$. If sway and sway rate are not available from external sensors, Sway Corrector 15 keeps its own internal model, based on the total acceleration $a_{tot}$. The output of Sway Corrector 15 is a correction acceleration, $a_c$. The internal processing of Sway Corrector 15 is described in further detail hereinbelow.

The function of Antisway Control 17 is to remove the sway induced earlier by response accelerations, and to remove the remaining one-half of the sway induced earlier by hoisting and by external factors and not removed by Sway Corrector 15. Antisway Control 17 also schedules the antisway acceleration to be executed later. The outputs of Antisway Control 17 are the antisway acceleration $a_a$, based on he current acceleration $a_r$ and $a_c$ and the predicted change in trolley velocity due to future antisway, $\Delta V_{pred}$. The internal processing of Antisway Control 17 is described in further detail hereinbelow.

Antisway Control. Given a sway-inducing trolley acceleration, the existing double-pulse anti-sway control law requires a second, delayed, trolley acceleration to kill the sway induced by the current acceleration. This law is adapted and extended to a sway-reinforcing pulse in the present invention, according to the following development.

Let θ be the sway angle of the load, measured in the opposite sense from trolley motion. That is, θ is positive when the trolley is moving in the positive direction and the load lags behind the trolley. If the load is suspended by a single attachment point or by parallel falls, so that the physical system is a simple pendulum, the defining differential equation for θ under trolley acceleration a is $$\ddot{\theta} = \frac{a\cos\theta - 2\dot{r}\dot{\theta} - g\sin\theta}{r} \tag{1}$$

where r is the pendulum length, g is the acceleration due to gravity, $\dot{r}$ and $\dot{\theta}$ are the derivatives of r and θ, respectively, with respect to time, and $\ddot{\theta}$ is the derivative of θ with respect to time. The linearized version of (1), valid for the range of sway angles encountered on the cranes under consideration here, is $$\ddot{\theta} = \frac{a - 2\dot{r}\dot{\theta} - g\theta}{r}. \tag{2}$$

The frequency (ω) of the sway is given by $$\sqrt{\frac{g}{r}},$$

where r is the pendulum length and g is acceleration due to gravity.

Suppose the trolley is accelerated with magnitude a at time $t_1$, for a time period of Δt, and the hoist rate, $\dot{r}$ is zero. Then r is constant, and the solution to (2) can be exactly canceled by another acceleration pulse that has the same magnitude a and duration Δt, this second acceleration beginning at time $$t_2 = t_1 + \frac{T}{2}, \tag{3}$$

where T is the sway period.

The present invention employs a generalization of this principle that the first acceleration can be reinforced by another acceleration that has magnitude −a and duration Δt beginning at time $t_2$ as given by equation (3), i.e., the sway induced by the second acceleration is exactly the same as the sway induced by the first acceleration. The application of this principle in the present invention is that to cancel the sway induced by a response acceleration $a_r$ and to reinforce the sway induced by a correction acceleration $a_c$, it suffices to execute an acceleration of $a_r - a_c$, delayed as in equation (3).

It is known (Virkkunen U.S. Pat. No. 5,127,533) that if the sway period changes due to a change in the pendulum length r, the sway-canceling (or sway-reinforcing) acceleration pulse can be rescheduled by varying the measurement of time to agree with the pendulum period, in accordance with the following analysis:

Let τ=ω. Then the unit of measurement of τ is cycles, and the period of the pendulum, measured in units of τ is always 1 cycle. If the derivatives in equation (1) are taken with respect to τ rather than t, the sway-canceling (or sway-reinforcing) acceleration pulse corresponding to a pulse at $\tau_1$ should always occur at $\tau_1$+½ cycles, and the duration required to cancel (respectively, reinforce) the sway energy induced by the original acceleration is Δτ, where Δτ is the original pulse's cycle duration. The Antisway Control 17 of the present invention implements a variable-rate sampler similar to the method taught by Virkkunen, but the approach in the present invention is different from Virkkunen's, in that it does not require a nominal hang length, but simply computes τ directly, as follows:

Antisway Control 17 constructs a circular buffer of length N, representing the number of acceleration pulses to be processed in a half cycle (200 pulses per half-cycle for one implementation). Each location in the buffer contains an antisway acceleration pulse to be executed at some future time; initially, the buffer entries are all zero. The Antisway control processes the contents of the buffer at a rate of one entry every $$\frac{1}{2N\omega}$$

seconds (referred to herein as Δt), and changes this rate based on the input r, from which it derives a sway frequency ω. At each processing cycle, the response acceleration $a_r$ is accepted from Response Control 14 and the correction acceleration $a_c$ is accepted from Correction Control 15. According to the principles above, the quantity $a_r - a_c$ is entered into the current buffer location. Each time a new buffer location is examined, the contents of that buffer location are taken to be the desired antisway acceleration $a_a$, to be applied immediately.

At any time, the contents of the circular buffer represent the total antisway acceleration planned for the future. Thus, at the then-current sampling interval of Δt seconds per buffer entry, the predicted change in trolley velocity due to scheduled antisway accelerations is $$\Delta V_{pred} = \sum_{i=1}^{N} a_i \Delta t, \tag{4}$$

where $a_i$ is the $i^{th}$ buffer entry. The Antisway Control 17 sends this value to the Response Control 14.

Sway Corrector. Define "sway energy", $E_{sway}$, by $$E_{sway} = \theta^2 + \left(\frac{\dot{\theta}}{\omega}\right)^2. \tag{5}$$

The square root of the sway energy is easily seen to be the maximum sway angle, in the absence of further trolley accelerations. Consequently, reducing $E_{sway}$ zero is equivalent to removing all sway. Rewriting (5) in terms of hoist length r, differentiating with respect to time, and combining with (2), one obtains $$\dot{E}_{sway} = \frac{-3\dot{r}\dot{\theta}^2 + 2a\dot{\theta}}{g}, \tag{6}$$

from which it is clear that sway energy is induced by change in r (i.e., hoisting), as well as by the trolley acceleration a, when the load is swinging. The trolley acceleration required to exactly cancel the change in energy due to hoisting can be obtained by setting $E_{sway}$ equal to zero in (6) and solving for a. The Sway Corrector 15 component of the present invention produces a correction acceleration pulse ($a_c$) that exactly cancels half of the sway energy induced by hoisting:

$$a_c = \frac{3}{4}\dot{r}\dot{\theta}.$$

Alternatively, if there is sensor input indicating θ,θ, then the Sway Corrector 15 finds the excess sway energy induced by both hoisting and all external factors by comparing the current sway energy, calculated from observation θ,θ and using equation (5), with the sway energy induced by trolley accelerations only, using an internal model based on total trolley acceleration, $a_{tot}$ derived from equation (6):

$$\Delta E_{sway} + E_{obs} - \int \frac{2a_{lot}\dot{\theta}}{g}\, dt \tag{8}$$

where $E_{obs}$ is the observed sway.

In either case, Sway Corrector 15 calculates a correction acceleration $a_c$ for immediate execution to remove half the excess, and Antisway Control 17 schedules an acceleration equal to $-a_c$ (as described previously herein above), which when executed reinforces the effect of the control acceleration $a_c$ and thereby cancels all the remaining sway energy induced by external effects. Because the two accelerations have opposite sign, the net effect of sway correction on $V_{pred}$ is zero.

Response Control. Suppose the input reference $V_{ref1}$ differs from the current trolley velocity.

When variable-rate sampling is employed, the reference velocity will not be automatically attained at the end of the antisway acceleration without further processing. This processing is provided by Response Control 14 function, which monitors the difference between the external velocity reference $V_{ref1}$ and the predicted velocity, given current velocity and hoist length. Instead of meeting half the demand, Response Control 14 determines an unconstrained acceleration $a_r$ to exactly meet the reference velocity, as follows:

$$a_r = \frac{V_{ref1} - V - \Delta V_{pred}}{\Delta t} \tag{9a}$$

where $V_{ref1}$=the input reference velocity

V=the current velocity $\Delta V_{pred}$=the predicted change in velocity due to scheduled antisway, as given in equation (6), and $\Delta t$ is the sampling interval.

The Response Control 14 then constrains the response acceleration to the two conditions $$|a_r - a_c| \leqq a_{max} \tag{9b}$$

and $$|a_r + a_c + a_a| \leqq a_{max} \tag{9c}$$

where $a_r$=the constrained response acceleration $a_c$=the correction acceleration $a_a$=the antisway acceleration, and $a_{max}$=the maximum acceleration to be used in moving the load.

The first equation (9*a*) ensures that the input trolley velocity reference will be met exactly, after all anti-sway pulses have been executed; the constraint (9*b*) ensures that the antisway acceleration that is scheduled for one-half cycle later can be executed; the constraint (9*c*) ensures that the combined response, correction, and antisway accelerations can be executed immediately.

All calculations described herein are made by computer and incorporated into the automatic crane controls.

It is thus seen that the invention provides a reliable and valuable control law for controlling sway in a load suspended from a trolley movable along a crane beam. Although the invention has been described relative to specific embodiments thereof, it is not so limited and there are numerous variations and modifications thereof that will be readily apparent to those skilled in the art in the light of the above teachings. It is therefore to be understood that, within the scope of the appended Claims, the invention may be practiced other than as specifically described herein.

What is claimed is:

1. A method for controlling the motion of a movable trolley from which a load is suspended at a variable hoist length therefrom, to meet an arbitrary horizontal velocity reference while preventing sway of the load, employing a computer-controlled control law for moving the trolley and comprising the steps of:

(a) determining a lateral acceleration $a_c$ to reduce by a factor of one-half the sway energy contributed by
(I) hoisting the load while the load is swaying,
(ii) non-linearities in the pendulum motion of the load, and
(iii) external forces;

(b) scheduling an additional lateral acceleration, having the same magnitude as $a_c$ but opposite sign, to be applied one-half a pendulum period later to correct the remaining half of the excess sway energy;

(c) determining a lateral acceleration $a_r$ to respond to the external velocity demand, taking into account the current trolley velocity and the predicted velocity change resulting from future sway-damping acceleration;

(d) determining a lateral acceleration $a_a$ required to damp sway previously induced by the trolley acceleration $a_r$, employing a time-delay transfer law;

(e) applying additively the accelerations $a_c$, $a_r$ and $a_a$ determined as in steps (a), (c) and (d) to accelerate the trolley; and (f) repeating steps (a), (b), (c), (d) and (e) at a sampling rate proportional to the sway period.

2. A method according to claim 1 wherein the response acceleration $a_r$ is constrained by $$|a_r - a_c| \leqq a_{max}$$

$$|a_r + a_c + a_a| \leqq a_{max}$$

where $a_{max}$ is the maximum acceleration to be used in moving the load.

3. A method according to claim 2, wherein the unconstrained response acceleration $a_r$ is determined according to the formula $$a_r = \frac{V_{ref1} - V - \Delta V_{pred}}{\Delta t}$$

where $a_r$=the unconstrained response acceleration, $\Delta t$=the current sampling interval, $v_{ref1}$=the external velocity reference signal, V=the current horizontal velocity, and $\Delta V_{pred}$ is the predicted change in velocity due to all scheduled accelerations, based on the current $\Delta t$.

4. A method of preventing hoist-induced sway of a load suspended by cables from a trolley moving along a crane beam, comprising:

(a) applying a lateral acceleration $a_c$ to the trolley to exactly counter half the change in sway energy resulting from hoisting while the load is swaying, according to the formula $$a_c = \frac{3}{4}\, \dot{r}\dot{\theta}$$

where $\theta$=sway angle rate $\dot{r}$=hoist rate; and (b) applying an additional lateral acceleration, having the same magnitude as $a_c$ but opposite sign, one-half a pendulum period later to correct the remaining half of the excess sway energy.

5. A method of counteracting externally-induced sway of a load suspended by cables from a movable trolley, comprising:

(a) determining the total sway energy based on sway angle θ, sway rate θ and pendulum frequency ω, according to the formula $$E_{sway} = \theta^2 + \left(\frac{\dot{\theta}}{\omega}\right)^2$$

where $E_{sway}$=the sway energy

θ=sway angle

θ=sway rate;

ω=pendulum frequency (b) determining the excess sway energy by comparing the observed sway energy to the sway energy induced by trolley accelerations, according to the formula $$\Delta E_{sway} + E_{obs} - \int \frac{2a_{tot}\dot{\theta}}{g}\, dt$$

where $\Delta e_{sway}$=excess sway energy $E_{obs}$=observed sway energy determined according to the formula in (a)

$a_{tot}$=trolley acceleration commanded by the disclosed process

θ=sway rate g=acceleration due to gravity;

(c) applying a lateral acceleration $a_c$ to the trolley to exactly counter half the excess sway energy as determined in (b); and (d) applying an additional lateral acceleration, having the same magnitude as $a_c$ but opposite sign, one-half a pendulum period later to correct the remaining half of the excess sway energy.

* * * * *

UNITED STATES PATENT AND TRADEMARK OFFICE

CERTIFICATE OF CORRECTION

PATENT NO. : 5,526,946
DATED : June 18, 1996
INVENTOR(S) : Robert H, Overton

It is certified that error appears in the above-identified patent and that said Letters Patent is hereby corrected as shown below:

Column 1,
Line 3, insert the following:

-- This invention was made with Government support under ISI-9024087 awarded by the National Science Foundation. The Government has certain rights in the invention. --

Signed and Sealed this

Twenty-second Day of June, 2004

JON W. DUDAS
*Acting Director of the United States Patent and Trademark Office*